US006311596B1

(12) United States Patent
Ratzel et al.

(10) Patent No.: US 6,311,596 B1
(45) Date of Patent: Nov. 6, 2001

(54) CUTTING ASSEMBLY FOR A CUSHIONING CONVERSION MACHINE

(75) Inventors: Richard O. Ratzel, Westlake; James A. Simmons, Painesville Township, both of OH (US)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 08/110,349

(22) Filed: Aug. 20, 1993

Related U.S. Application Data

(63) Continuation-in-part of application No. 08/066,337, filed on May 21, 1993, now abandoned, which is a continuation of application No. 07/840,306, filed on Feb. 24, 1992, now abandoned, said application No. 07/840,306, is a division of application No. 07/712,203, filed on Jun. 7, 1991, now Pat. No. 5,123,889, which is a continuation-in-part of application No. 07/547,572, filed on Oct. 5, 1990, now Pat. No. 5,322,477.

(51) Int. Cl.[7] ..... B26D 1/04

(52) U.S. Cl. ..... 83/157; 493/352; 493/372; 493/967

(58) Field of Search ..... 83/157, 628, 630; 493/346, 349, 350, 352, 967

(56) References Cited

U.S. PATENT DOCUMENTS

| | | | |
|---|---|---|---|
| 510,346 | 12/1893 | Keist . | |
| 1,333,940 | 3/1920 | Seymour . | |
| 1,509,835 | 9/1924 | Grossenbach . | |
| 1,569,569 | 1/1926 | Pels | 83/632 X |
| 1,958,132 | 5/1934 | Davis | 164/41 |

(List continued on next page.)

FOREIGN PATENT DOCUMENTS

| | | | |
|---|---|---|---|
| 477 252 * | 10/1969 | (CH) | 83/157 |

*Primary Examiner*—M Rachuba
(74) *Attorney, Agent, or Firm*—Renner, Otto, Boisselle & Sklar, L.L.P.

(57) ABSTRACT

A cushioning conversion machine for converting sheet-like stock material into cut sections of a pad-like cushioning dunnage product is provided. The machine includes a frame, conversion assemblies which convert the sheet-like stock material into the cushioning dunnage product, and a cutting assembly (56) which cuts the cushioning dunnage product into cut sections. The frame (46) includes an outlet opening (48) through which the cushioning dunnage product emerges. The cutting assembly (56), which is mounted downstream of the outlet opening (48), comprises a first blade (160) and a second blade (162). The second blade (162) is mounted on the frame (46) in such a manner that it travels between a rest position whereat it is removed from the first blade (160) to a cutting position whereat it coacts with the first blade (160) to cut the cushioning dunnage product into a cut section. The cutting assembly (56) further comprises an automatic alignment device (200) which automatically aligns the cut section with the outlet opening (48) when the second blade (162) is moved from the cutting position to the rest position.

16 Claims, 9 Drawing Sheets

U.S. PATENT DOCUMENTS

| | | | | |
|---|---|---|---|---|
| 1,989,794 | | 1/1935 | Duvall | 154/54 |
| 2,101,170 | | 12/1937 | Engel | 271/76 |
| 2,107,462 | | 2/1938 | Wood | 270/37 |
| 2,208,966 | | 2/1940 | Eickman | 83/630 X |
| 2,273,162 | | 2/1942 | Willard | 271/2.1 |
| 2,425,123 | | 8/1947 | Quayle et al. | 164/17 |
| 2,494,413 | | 1/1950 | Slettengren | 83/630 |
| 2,569,589 | | 10/1951 | Trissell | 242/58 |
| 2,721,709 | | 10/1955 | Auerbacher | 242/58 |
| 2,810,597 | | 10/1957 | Poss | 287/103 |
| 2,860,703 | | 11/1958 | O'Donnell | 164/42 |
| 2,882,802 | | 4/1959 | Walker | 93/1 |
| 2,935,002 | | 5/1960 | Robinson, Jr. | 93/1.1 |
| 2,973,678 | * | 3/1961 | Scott et al. | 83/157 X |
| 3,069,107 | | 12/1962 | Hirt | 242/79 |
| 3,089,716 | | 5/1963 | Berkowitz | 287/54 |
| 3,136,462 | | 6/1964 | Knutson | 225/24 |
| 3,238,852 | | 3/1966 | Schur | 93/1 |
| 3,260,145 | * | 7/1966 | Giordano | 83/157 X |
| 3,266,794 | | 8/1966 | Weir | 270/81 |
| 3,283,874 | | 11/1966 | Goreham | 197/126 |
| 3,323,983 | | 6/1967 | Palmer et al. | 162/362 |
| 3,325,120 | | 6/1967 | Brinkman | 242/86.5 |
| 3,377,224 | | 4/1968 | Gresham et al. | 156/209 |
| 3,415,554 | | 12/1968 | Papayoti | 287/189 |
| 3,426,635 | | 2/1969 | Nicklasson | 83/630 |
| 3,509,797 | | 5/1970 | Johnson | 93/1 |
| 3,603,216 | | 9/1971 | Johnson | 93/1 WZ |
| 3,606,410 | | 9/1971 | Inserra | 287/127 |
| 3,613,522 | | 10/1971 | Johnson | 93/1 |
| 3,650,419 | | 3/1972 | Upshur et al. | 214/38 |
| 3,650,877 | | 3/1972 | Johnson | 161/47 |
| 3,655,500 | | 4/1972 | Johnson | 161/104 |
| 3,695,133 | | 10/1972 | Finke | 83/204 |
| 3,735,445 | | 5/1973 | Jurcak | 17/71 |
| 3,738,212 | | 6/1973 | Goodale | 83/602 |
| 3,789,757 | | 2/1974 | Motter et al. | 101/153 |
| 3,799,031 | | 3/1974 | Hallenbeck et al. | 91/189 |
| 3,817,139 | | 6/1974 | Desai | 83/632 X |
| 3,842,699 | * | 10/1974 | Zyl | 83/157 |
| 3,880,372 | | 4/1975 | Witte | 242/55 |
| 3,898,920 | | 8/1975 | Zucker | 93/1 |
| 3,899,166 | | 8/1975 | Behn | 270/83 |
| 3,924,504 | * | 12/1975 | Kurtz | 83/157 X |
| 3,941,021 | | 3/1976 | Meinholdt | 83/604 |
| 4,026,198 | | 5/1977 | Ottaviano | 93/1 |
| 4,059,256 | | 11/1977 | Palmer | 270/52 |
| 4,198,888 | | 4/1980 | Gatt | 83/467 |
| 4,237,776 | | 12/1980 | Ottaviano | 493/382 |
| 4,258,846 | | 3/1981 | Campo | 206/412 |
| 4,557,716 | | 12/1985 | Ottaviano | 493/464 |
| 4,579,027 | * | 4/1986 | Lewis | 83/157 X |
| 4,619,635 | | 10/1986 | Ottaviano | 493/36 |
| 4,699,609 | | 10/1987 | Komaransky et al. | 493/357 |
| 4,717,613 | | 1/1988 | Ottaviano | 428/129 |
| 4,750,896 | | 6/1988 | Komaransky et al. | 493/357 |
| 4,839,210 | | 6/1989 | Komaransky et al. | 428/77 |
| 4,884,999 | | 12/1989 | Baldacci | 493/439 |
| 4,937,131 | | 6/1990 | Baldacci et al. | 428/131 |
| 4,968,291 | | 11/1990 | Baldacci et al. | 493/354 |
| 5,042,345 | | 8/1991 | Hawkins | 83/628 |
| 5,088,370 | | 2/1992 | Kondo | 83/602 |
| 5,123,889 | | 6/1992 | Armington | 493/346 |

* cited by examiner

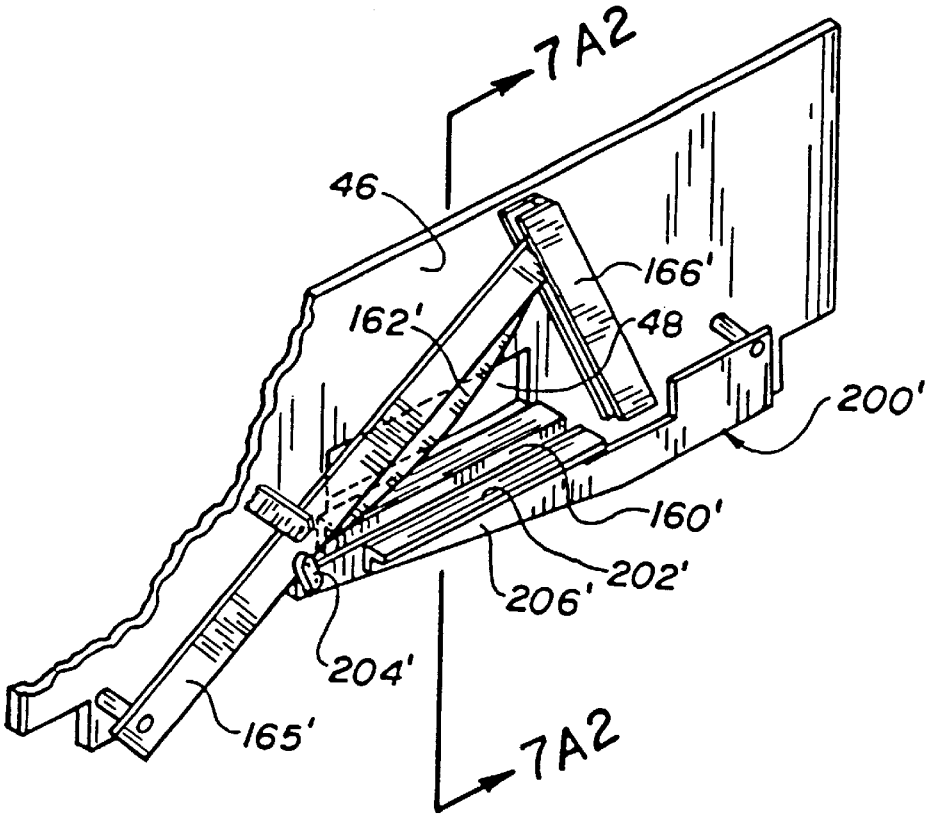
FIG. 7A1
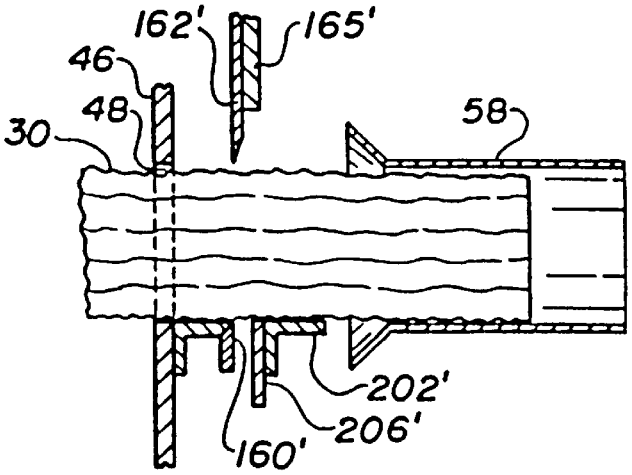
FIG. 7A2

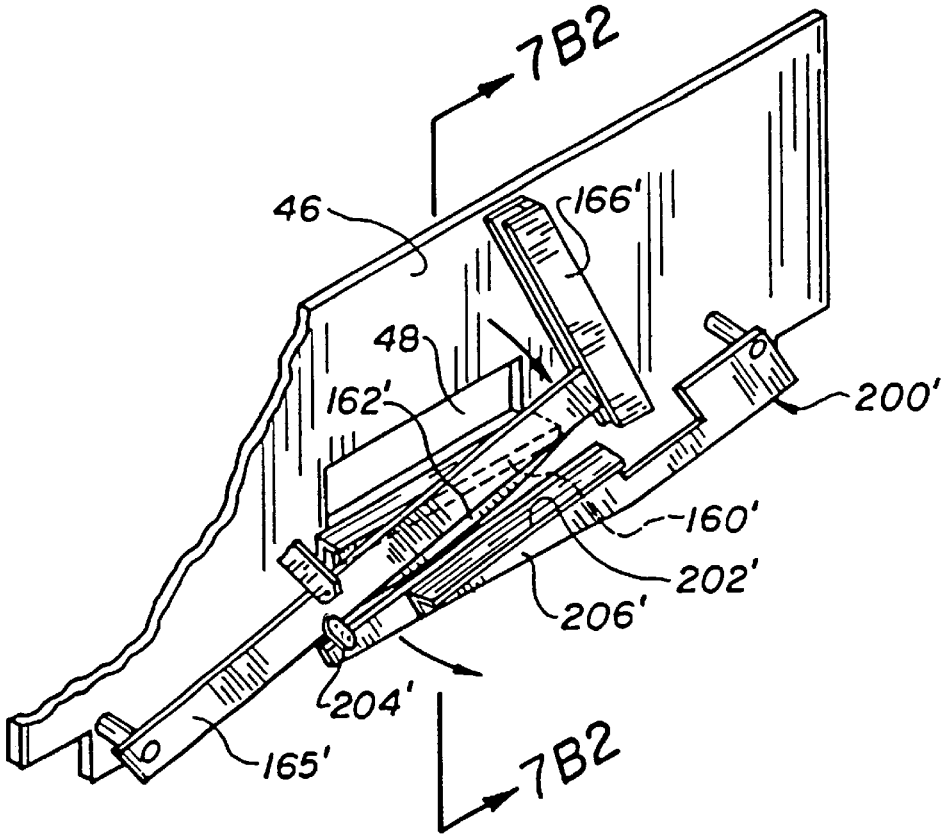
FIG. 7B1
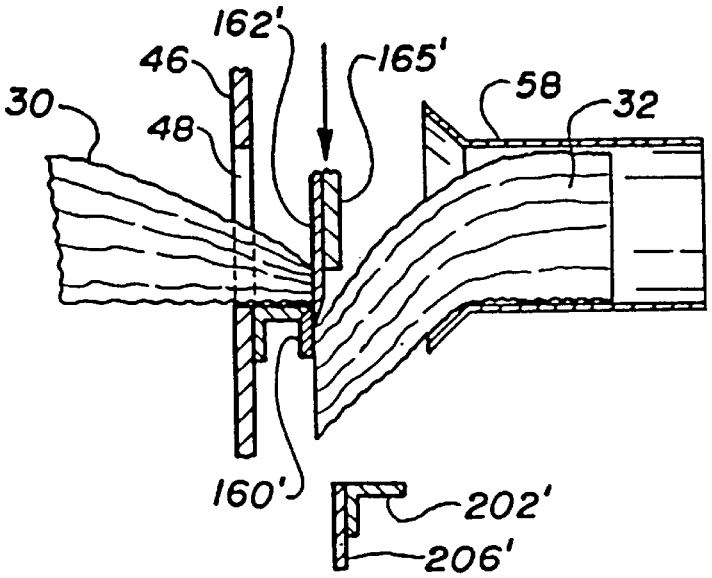
FIG. 7B2

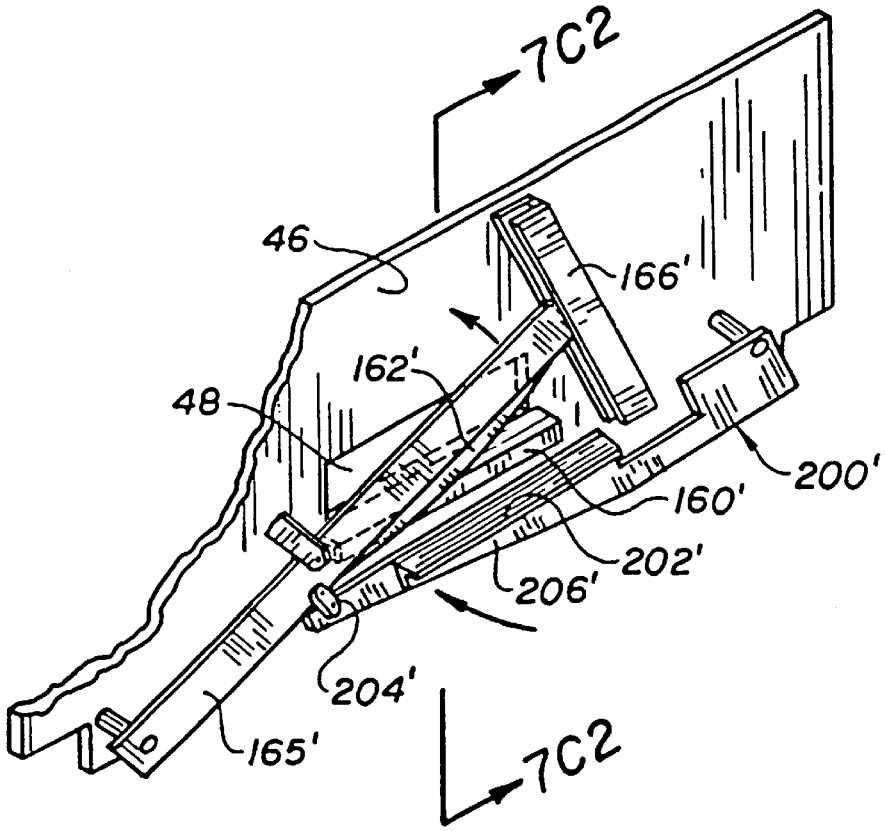
FIG. 7C1
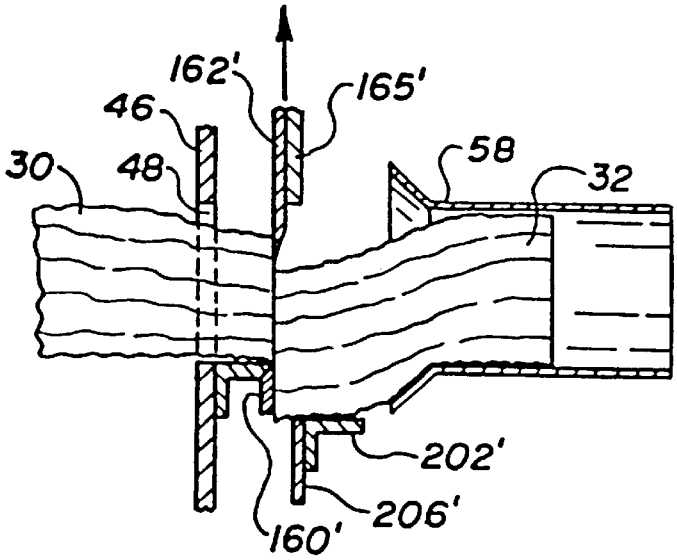
FIG. 7C2

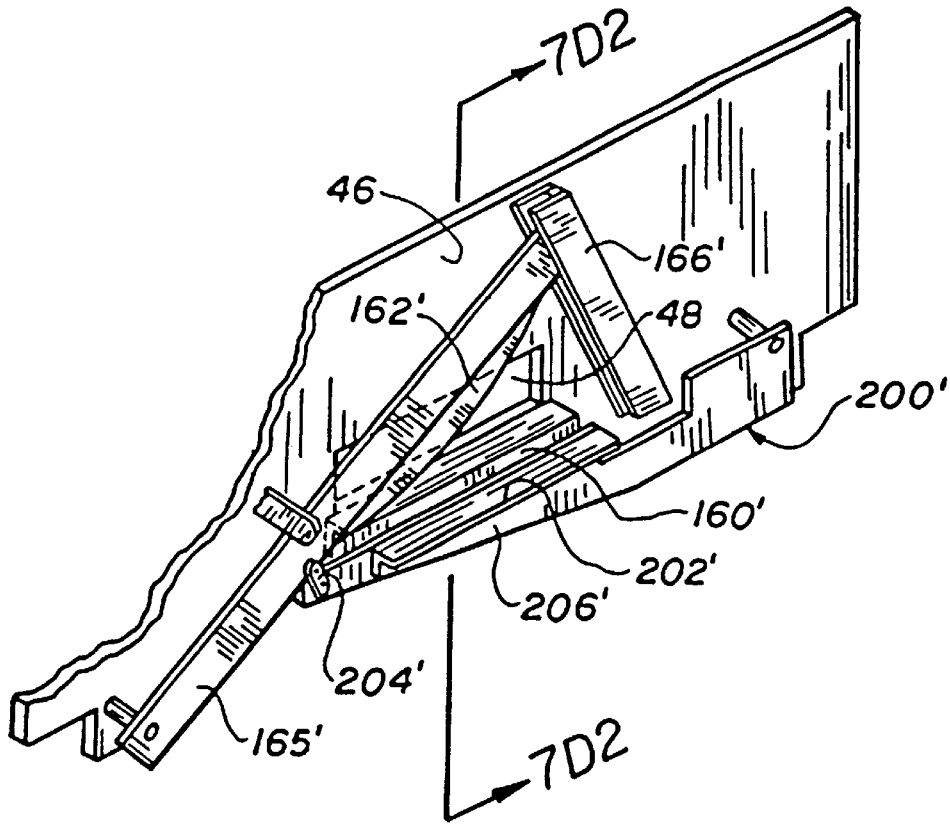
FIG. 7D1
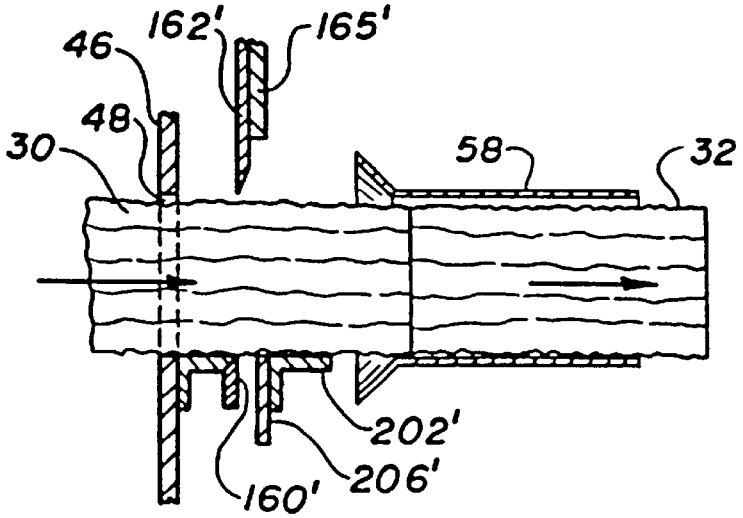
FIG. 7D2

CUTTING ASSEMBLY FOR A CUSHIONING CONVERSION MACHINE

RELATED APPLICATIONS

This application is a continuation-in-part of U.S. application Ser. No. 08/066,337, filed May 21, 1999 now abandoned, which was a continuation of U.S. application Ser. No. 07/840,306, filed Feb. 24, 1992 now abandoned. U.S. application Ser. No. 07/840,306, filed Feb. 24, 1992 was a divisional application of U.S. application Ser. No. 07/712,203, filed Jun. 7, 1991 now U.S. Pat. No. 5,123,889, which was a continuation-in-part of U.S. application Ser. No. 07/592,572 filed Jun. 7, 1991 now U.S. Pat. No. 5,322,477. These earlier applications are assigned to the assignee of the present application and their entire disclosures are hereby incorporated by reference.

FIELD OF THE INVENTION

This invention relates as indicated to a cutting assembly for a cushioning conversion machine. Particularly, this invention relates to a cutting assembly which insures correct alignment of a cut section of dunnage material relative to other key components of the machine. More particularly, the cutting assembly includes an automatic alignment device which automatically "re-aligns" the cut section with an outlet opening and a post-cutting constraining assembly during the return stroke of a moving blade.

BACKGROUND AND SUMMARY OF THE INVENTION

In the process of shipping an item from one location to another, a protective packaging material is typically placed in the shipping case, or box, to fill any voids and/or to cushion the item during the shipping process. Some conventional commonly used protective packaging materials are plastic foam peanuts and plastic bubble pack. While these conventional plastic materials seem to adequately perform as cushioning products, they are not without disadvantages. For example, one drawback of plastic bubble film is that it usually includes a polyvinylidene chloride coating. This coating prevents the plastic film from being safely incinerated, which often creates disposal difficulties. Additionally, both the plastic foam peanuts and the plastic bubble pack have a tendency to generate a charge of static electricity attracting dust from the surrounding packaging site. Also, these plastic materials sometimes themselves produce a significant amount of packaging "lint." Such dust and lint particles are generally undesirable and may even be destructive to sensitive merchandise such as electronic or medical equipment.

But perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials has made paper protective packaging material a very popular alterative. Paper is biodegradable, recyclable and renewable; making it an environmentally responsible choice for conscientious industries. Additionally, paper may be safely incinerated by the recipients of the products. Furthermore, paper protective packaging material is perfect for particle-sensitive merchandise, as its clean dust-free surface is resistant to static cling.

While paper in sheet form could possibly be used as a protective packaging material, it is usually preferable to convert the sheets of paper into a relatively low density pad-like cushioning dunnage product. This conversion may be accomplished by a cushioning conversion machine, such as that disclosed in U.S. application Ser. Nos. 07/840,306; 07/840,306; 07/712,203 (now U.S. Pat. No. 5,123,889); and Ser. No. 07/592,572. (These applications are all assigned to the assignee of the present invention.) Such a cushioning conversion machine converts sheet-like stock material, such as paper in multi-ply form, into cut sections of a relatively low density pad-like cushioning product. The stock material may consist of three superimposed webs or layers of biodegradable, recyclable and reusable thirty-pound Kraft paper rolled onto a hollow cylindrical tube. A thirty-inch roll of this paper, which is approximately 450 feet long, will weigh about 35 pounds and will provide cushioning equal to approximately four fifteen cubic foot bags of plastic foam peanuts while at the same time requiring less than one-thirtieth the storage space.

Specifically, the machine converts the stock material into a continuous unconnected strip having lateral pillow-like portions separated by a thin central band. This strip is connected or coined along the central band to form a coined strip which is cut into sections of a desired length. The cut sections each include lateral pillow-like portions separated by a thin central band and provide an excellent relatively low density pad-like product which may be used instead of conventional plastic protective packaging material.

The cushioning conversion machine disclosed in the above-identified applications includes a frame having an upstream end and a downstream end. (The terms "upstream" and "downstream" in this context are characteristic of the direction of flow of the stock material through the machine.) The frame is formed from a base plate, an upstream end plate, and a downstream end plate. The downstream end plate is generally rectangular and includes a relatively small rectangular outlet opening. The frame also includes a box-like extension removably attached to a downstream portion of the base plate.

The machine further includes a stock supply assembly, a forming assembly, a gear assembly, a cutting assembly, and a post cutting constraining assembly, all of which are mounted on the machine frame. In operation of the machine, the stock supply assembly supplies the stock material to the forming assembly. The forming assembly causes inward rolling of the lateral edges of the sheet-like stock material to form the lateral pillow-like portions of the continuous strip. The gear assembly pulls the stock material through the machine and also coins the central band of the continuous strip to form the coined strip. The coined strip travels downstream from the gear assembly and through the outlet opening in the end plate. The cutting assembly, which is mounted on the downstream side of the end plate, cuts the coined strip into sections of a desired length. These cut sections then travel through the post-cutting constraining assembly.

The post-cutting constraining assembly, which is of particular interest in the present application, is located downstream of the cutting assembly and is mounted on the box-like extension. The post-cutting constraining assembly is basically funnel-shaped and is positioned so that its inlet is aligned with the outlet opening of the end plate. A cut section will be urged or pushed downstream through the post-cutting constraining assembly by the approaching coined strip. As the cut section passes through the post-cutting constraining assembly, it is constrained circumferentially to improve its cushioning quality.

The post-cutting constraining assembly has proven to be a very advantageous feature in a cushioning conversion machine. However, in order to be effective, the cross-sectional geometry of the post-cutting constraining assembly must closely approximate that of a cut section. Moreover, as was explained above, it is the urging of the approaching coined strip which pushes the cut section through the post-cutting constraining assembly. Consequently, it is important for the cut section to be aligned both with the outlet of the end plate and with the inlet of the post-cutting constraining assembly. In other words, the cut section must have a smooth transition into the post-cutting constraining assembly.

In the above-identified applications, the cutting assembly includes a stationary blade and a moving blade, both of which are strategically positioned relative to the outlet opening. During operation of the cutting assembly, the moving blade travels between a rest position and a cutting position. More specifically, the moving blade will travel through one cycle of making a cutting stroke and a return stroke to the rest position. During the cutting stroke, the moving blade travels across the outlet opening and coacts with the stationary blade. For example, the moving blade can coact with the stationary blade in a "guillotine-like" fashion or, alternatively, coact with the stationary blade in a "scissor-like" fashion.

Applicants believe that the cutting assemblies disclosed in the above-identified applications adequately perform their cutting functions. Nonetheless, applicants also appreciated that, in certain situations, alignment problems might be created due to the action of the moving blade. Specifically, the action of the moving blade during the cutting stroke sometimes tends to misalign the cut section relative to the outlet opening and/or the inlet to the post-cutting constraining assembly. As the moving blade returns to the rest position, the cut section will sometimes "rebound" back into alignment. However, the cut section often remains at least partially misaligned even after the return stroke of the blade.

Accordingly, applicants developed the cutting assembly of the present invention to insure correct alignment of the cut section relative to the outlet of the end plate and the inlet of the post-cutting constraining assembly. Specifically, the cutting assembly includes an automatic alignment device which automatically "re-aligns" the cut section with the outlet opening and the post-cutting constraining assembly during the return stroke of the moving blade. In other words, the alignment device insures a smooth transition for the cut section from the outlet opening through the post-cutting constraining assembly. In this manner, the cut section steadily continues its downstream travel as it is pushed by the approaching coined strip.

More particularly, the present invention provides a cushioning conversion machine for converting sheet-like stock material into cut sections of a pad-like cushioning dunnage product. The machine comprises a frame, conversion assemblies which convert the sheet-like stock material into the cushioning dunnage product, and a cutting assembly which cuts the cushioning dunnage product into cut sections. The frame includes an outlet opening through which the cushioning dunnage product emerges. The cutting assembly, which is mounted downstream of the outlet opening, comprises a first blade and a second blade. The second blade is mounted on the frame in such a manner that it travels between a rest position whereat it is removed from the first blade to a cutting position whereat it coacts with the first blade to cut the cushioning dunnage product into a cut section. The cutting assembly further comprises an automatic alignment device which automatically aligns the cut section with the outlet opening when the second blade is moved from the cutting position to the rest position.

The machine may further comprise a post-cutting constraining assembly which circumferentially and longitudinally constrains the cut sections. The post-cutting constraining assembly, which is mounted on the frame downstream of the cutting assembly, includes an inlet which is aligned with the outlet opening. Thus, the automatic alignment device automatically aligns the cut section with the inlet when the second blade is moved from the cutting position to the rest position.

Additionally or alternatively, the cutting assembly may further comprise an automatic interruption switch which automatically temporarily stops the production of the dunnage product when the second blade is removed from the rest position. In the preferred embodiment, such an automatic interruption switch would be electrically connected to the pulling/connecting assembly (or the gear assembly) of the machine. Specifically, the automatic interruption switch would comprise a depressible button which allows operation of the pulling/connecting assembly when it is in a depressed condition and which interrupts operation of the pulling/connecting assembly when it is in a released condition.

The present invention provides these and other features hereinafter fully described and particularly pointed out in the claims. The following description and annexed drawings set forth in detail certain illustrative embodiments of the invention. These embodiments are indicative, however, of but a few of the various ways in which the principles of the invention may be employed.

BRIEF DESCRIPTION OF THE DRAWINGS

In the annexed drawings:

FIGS. 7A1–7D1 are perspective schematic views of the cutting assembly of FIG. 6, the post-cutting constraining assembly, and relevant portions of the machine frame; and FIGS. 7A2–7D2 are side schematic views of the cutting assembly of FIG. 6, the post-cutting constraining assembly, and relevant portions of the machine frame.

DETAILED DESCRIPTION

Figure 1:
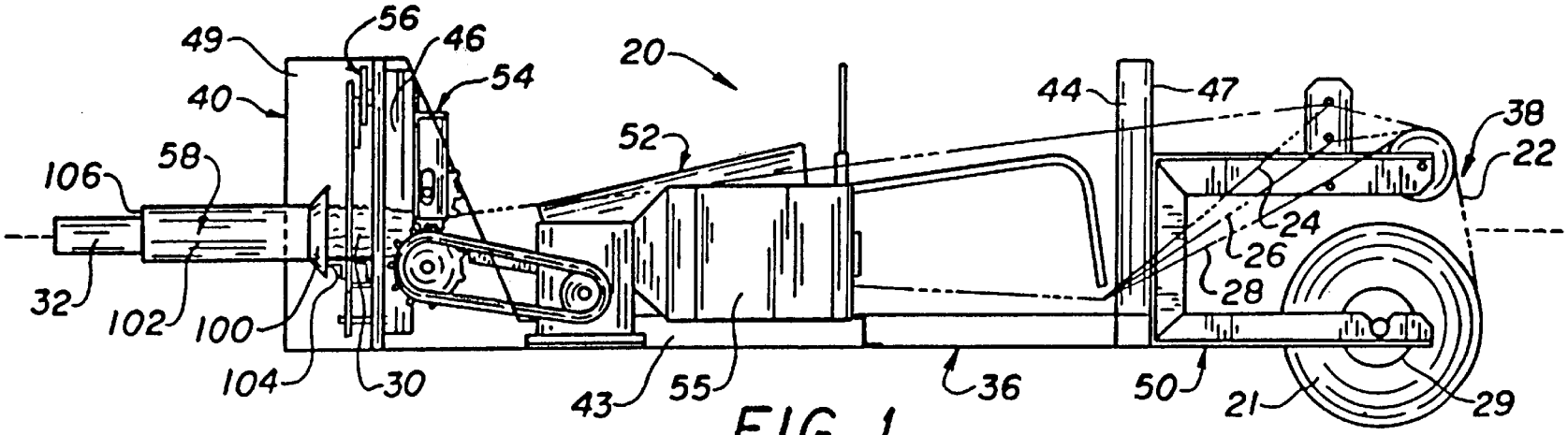
FIG. 1 is a side view of a cushioning conversion machine according to the present invention, the machine including a stock supply assembly, a forming assembly, a gear assembly, a cutting assembly, and a post cutting constraining assembly, all of which are mounted on a machine frame.
Figure 2:
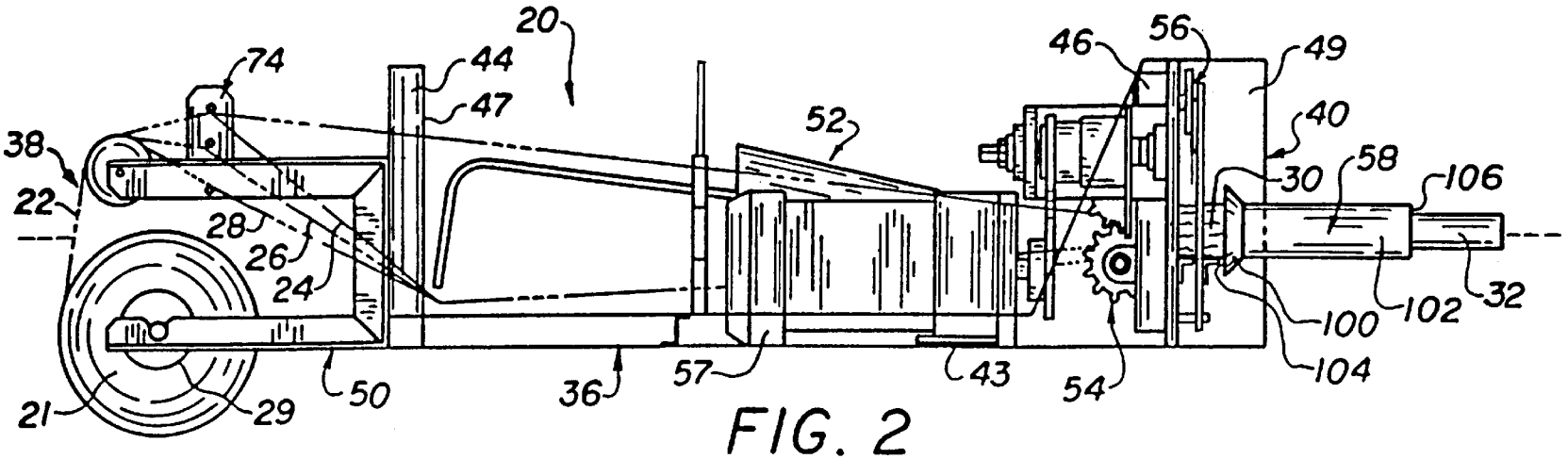
FIG. 2 is an opposite side view of the cushioning conversion machine.
Figure 3:
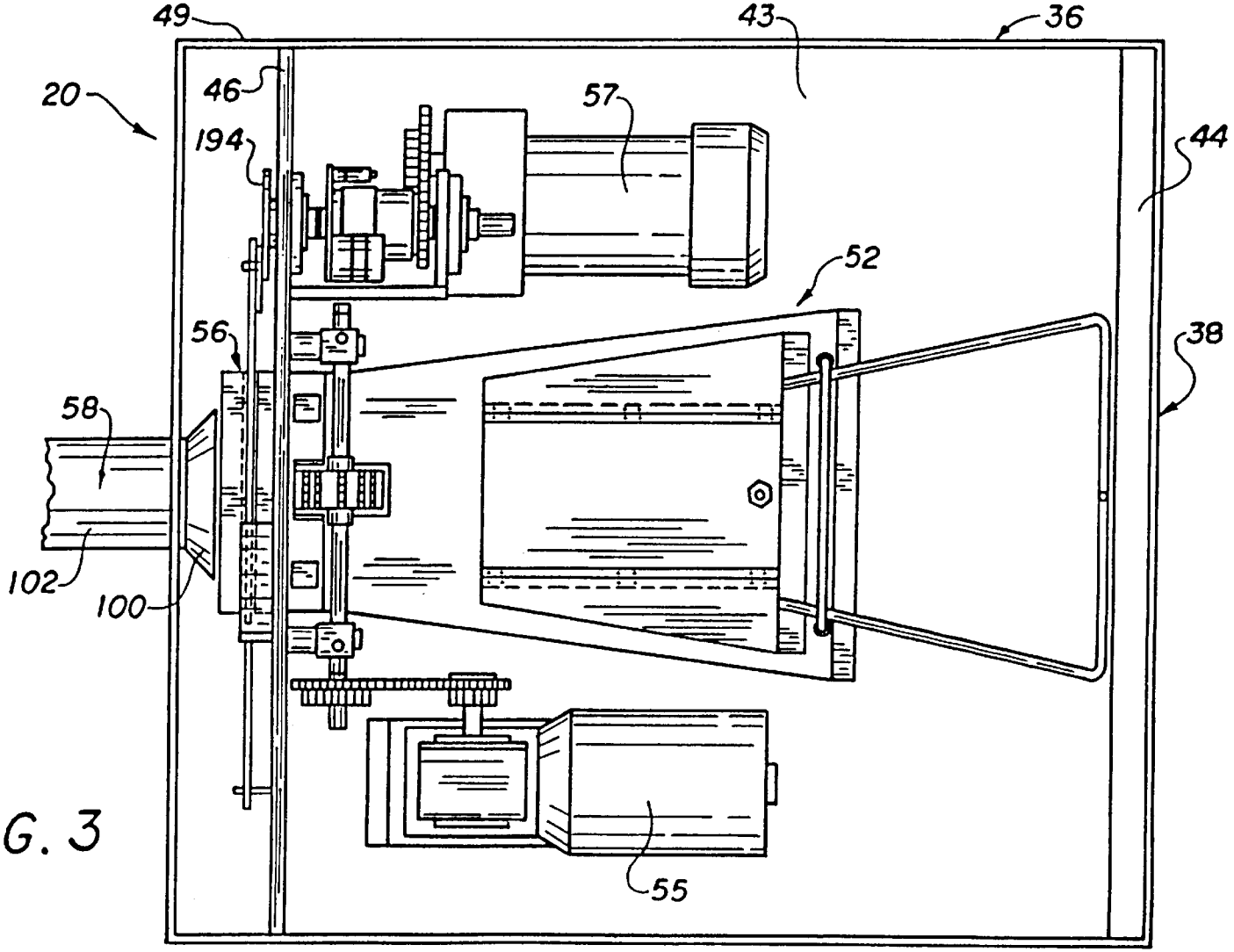
FIG. 3 is a top plan view of the cushioning conversion machine.

Referring now to the drawings in detail and initially to FIGS. 1 through 3, a cushioning conversion machine according to the present invention is indicated generally at 20. In FIGS. 1 and 2, the machine 20 is shown positioned in a horizontal manner and loaded with a roll 21 of sheet-like stock material 22. The stock material 22 may consist of three superimposed webs or layers 24, 26, and 28 of biodegradable, recyclable and reusable thirty-pound Kraft paper rolled onto a hollow cylindrical tube 29. The machine 20 converts this stock material 22 into a continuous unconnected strip having lateral pillow-like portions separated by a thin central band. This strip is connected or coined along the central band to form a coined strip 30 which is cut into sections 32 of a desired length.

The machine 20 includes a frame, indicated generally at 36, having an upstream end 38 and a downstream end 40. (The terms "upstream" and "downstream" in this context are characteristic of the direction of flow of the stock material 22 through the machine 20.) The frame 36 is formed from a base plate 43 and two end plates 44 and 46. The frame base plate 43 is generally rectangular and extends from the upstream end 38 to the downstream end 40 of the frame 36 in a generally horizontal plane. Although not perfectly apparent from the illustrations, the first or upstream frame end plate 44 may be more specifically described as a thin rectangular wall having a rectangular stock inlet opening 47 passing therethrough. The second or downstream frame end plate 46 is generally rectangular and planar and includes a relatively small rectangular outlet opening 48. The outlet opening 48 may be seen more clearly by briefly referring to FIG. 4.

The first frame end plate 44 extends generally perpendicular in one direction from the upstream end of the frame base plate 43. In the illustrated embodiment of FIGS. 1 and 2, this direction is upward. The second end plate 46 is preferably aluminum and extends in generally the same perpendicular direction from the downstream end of the frame base plate 43. In this manner, the frame 36 is basically "C" shape and one side of the frame base plate 43, which in the illustrated orientation is the lower side, is a flat uninterrupted surface. The frame 36 also includes a box-like extension 49 removably attached to a downstream portion of the base plate 43.

The machine 20 further includes a stock supply assembly 50, a forming assembly 52, a gear assembly 54 powered by a gear motor 55, a cutting assembly 56 powered by a cutter motor 57, and a post cutting constraining assembly 58; all of which are mounted on the frame 36. The stock supply assembly 50 is mounted to an upstream side of the first frame end plate 44. The forming assembly 52 is located downstream of the stock supply assembly 50 and is mounted on an intermediate portion of the frame base plate 43. The gear assembly 54 is located downstream of the forming assembly 52 and is mounted on an upstream side of the second frame end plate 46. On the opposite downstream side of the frame end plate 46, the cutting assembly 56 is mounted. The motors 55 and 57 are mounted on the frame base plate 43 at about the same level as the forming assembly 52 and on opposite sides thereof. Finally, the post-cutting constraining assembly 58 is located downstream of the cutting assembly 56 and is mounted on the box-like extension 49.

In operation of the machine 20, the stock supply assembly 50 supplies the stock material 22 to the forming assembly 52. The forming assembly 52 causes inward rolling of the lateral edges of the sheet-like stock material 22 to form the lateral pillow-like portions of the continuous strip. The gear assembly 54 actually performs dual functions in the operation of the machine 20. One function is a "pulling" function in which the paper is drawn through the nip of the two cooperating and opposed gears of the gear assembly. Thus, the gear assembly 54 is the mechanism which pulls the stock material 22 from the stock roll 21, through the stock supply assembly 50, and through the forming assembly 52. The second function performed by the gear assembly 54 is a "coining" or "connecting" function. Specifically, the gear assembly 54 connects the strip by the two opposing gears coining its central band passing therethrough to form the coined strip 30. As the coined strip 30 travels downstream from the gear assembly 54, the cutting assembly 56 cuts the strip into sections 32 of a desired length. These cut sections 32 then travel through the post-cutting constraining assembly 58.

The post-cutting constraining assembly 58 is basically funnel-shaped and includes an upstream converging portion 100 which tapers into a downstream rectangular tunnel portion 102. The converging portion 100 is located between the downstream frame end plate 46 and the extension 49, while the tunnel portion 102 extends through and beyond the frame extension 49. The post-cutting constraining assembly 58 is positioned so that its inlet 104 is aligned with the outlet opening 48 of the end plate 46. The downstream outlet 106 of the post-cutting constraining assembly 58 is also preferably aligned with the outlet opening 48 and also the inlet 104.

A cut section 32 will be urged or pushed downstream through the post-cutting constraining assembly 58 by the approaching coined strip 30. The converging portion 100 smoothly urges the section 32 into the tunnel portion 102. As the cut section 32 passes through the tunnel portion 102, it is generally constrained circumferentially. A cut section 32 emerging from the post-cutting constraining assembly 58 may be directed to a desired packing location, the conversion of the stock material 22 to cut sections 32 of relatively low density pad-like cushioning dunnage product now being complete.

Figure 4:
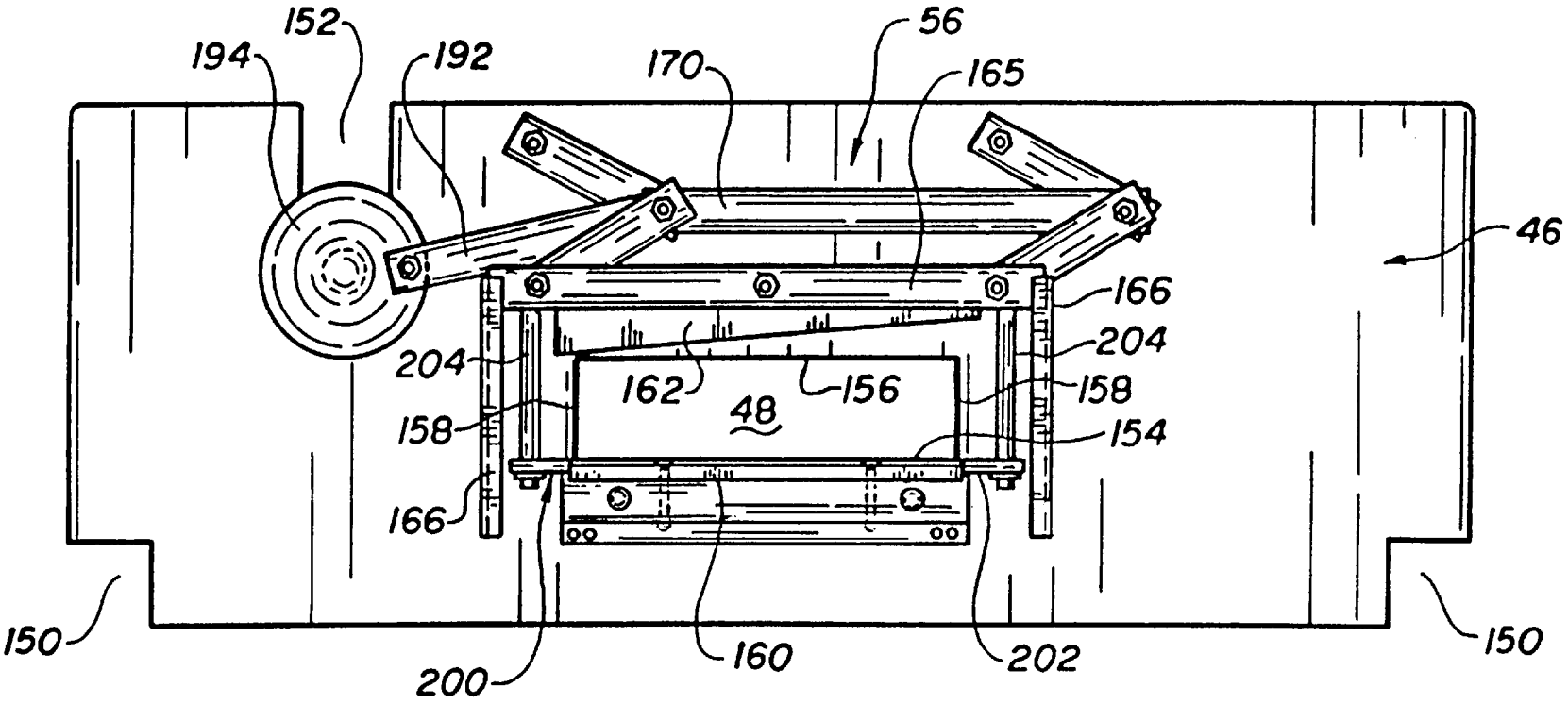
FIG. 4 is an isolated elevation view of the cutting assembly and relevant portions of the machine frame.

Details of the cutting assembly 56 and the frame end plate 46 may be seen in FIG. 4 where these components are illustrated isolated from the rest of the machine 20. As shown, the roughly rectangular end plate 46 has two square notches 150 at the corners on its proximal side and an offset open slot 152 on its distal side. The terms "proximal" and "distal" in this context refer to the location along the side relative to the frame base plate 43. The square notches 150 coordinate with the frame base plate 43 for attachment purposes and the offset open slot 152 accommodates the drive of the cutting assembly 56. Regarding the rectangular outlet opening 48, it is defined by a proximal side 154, a distal side 156, and two smaller lateral sides 158.

The cutting assembly 56 includes a stationary blade 160 and a moving blade 162, both of these blades being strategically positioned relative to the outlet opening 48. The blades 160 and 162 are the actual "cutting" elements of the cutting assembly 56 and coact in a guillotine fashion to cut the coined strip 30 into the cut sections 32. The stationary blade 160 is fixedly mounted on the frame end plate 46 in such a manner that it is aligned with the proximal side 154 of the outlet opening 48. The moving blade 162 is mounted on a support bar 165 which is slidably mounted on the end plate 46 within cutter guide tracks 166. The cutter guide tracks 166 are positioned beyond and parallel to the lateral sides 158 of the outlet opening 48. The bars 166 also extend beyond the proximal/distal sides 154/156 of the outlet opening 48.

The support bar 165 is connected to a cutter linkage 170. The cutter linkage 170 is connected, via a drive link 192, to a tangential portion of a motion disk 194. A shaft (not specifically shown or numbered) is connected at one end to the motion disk 194 and extends from the downstream side of the frame end plate 46, through the open offset slot 152 to the upstream side of the plate 46. The opposite end of the shaft is operably connected to the cutter motor 57.

The cutting assembly 56 additionally includes an alignment device 200. The alignment device 200 includes an alignment member 202 which is interconnected with the moving blade 162 via connecting members 204. In the embodiment illustrated in FIG. 4, the alignment member 202 is a planar shelf and the connecting members 204 are rod-like members which extend between respective outer lateral portions of the alignment member 202 and the support bar 165. In this manner, the connecting members 204 are positioned between the outlet's lateral sides 158 and the guide tracks 166 whereby they will not interfere with the travel of the coined strip 30 through the outlet opening 48.

During operation of the cutting assembly 56, the motion disk 194 is rotated so that moving blade 162 travels between a rest position and a cutting position. More specifically, the position of the drive link 192 is varied to drive the cutter linkage 170 to move the support bar 165 (and thus the moving blade 162 and the alignment member 202) to and fro within the guide tracks 166 at a desired interval. As is explained in more detail below, during one rotation of the motion disk 194, the moving blade 162 will travel through one cycle of making a cutting stroke and a return stroke to the rest position.

Figure 5A:
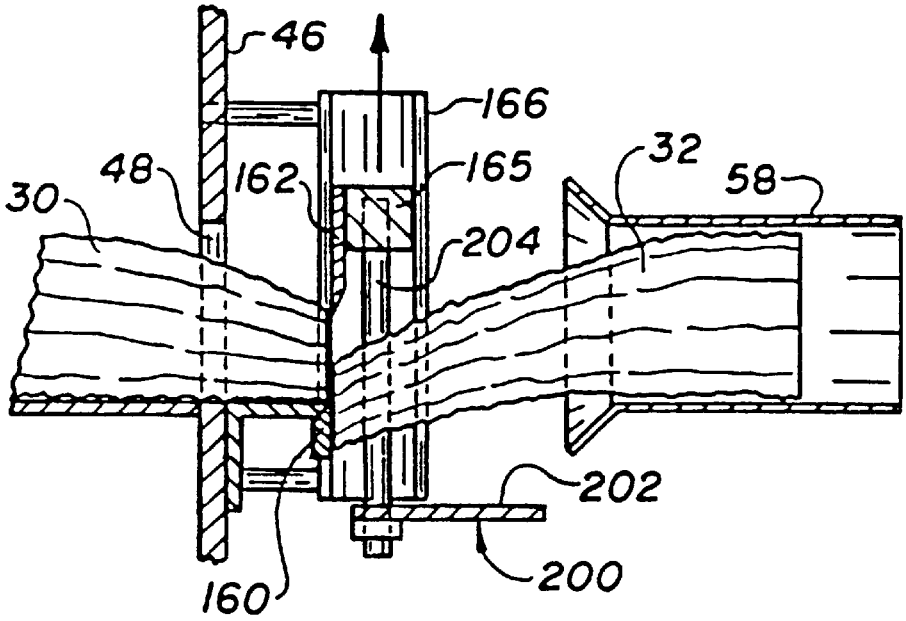
FIGS. 5A and 5B are side schematic views of the cutting assembly, the post-cutting constraining assembly, and relevant portions of the machine frame.
Figure 5B:
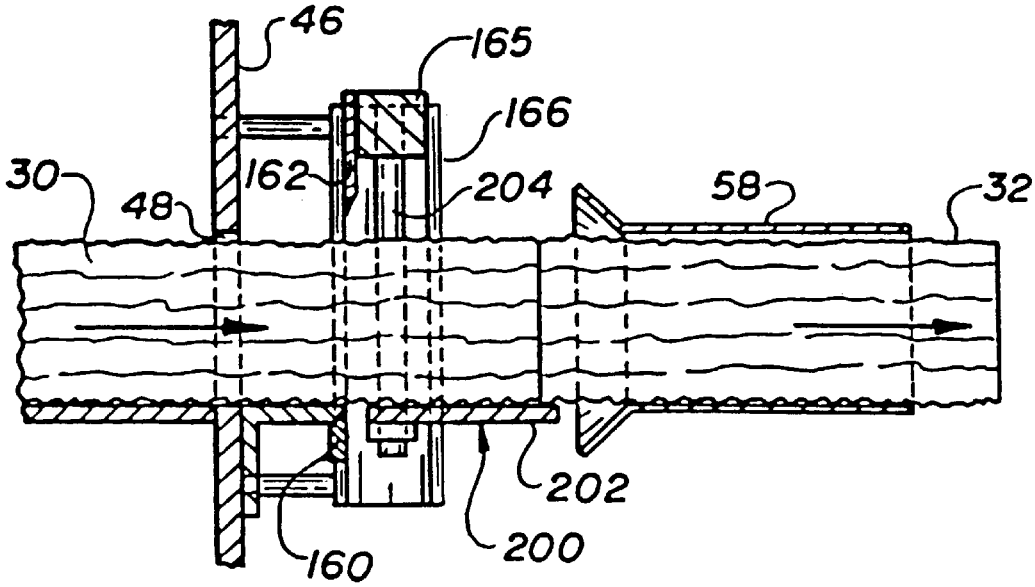

The interaction between the cutting blades 160/162, the alignment device 200, and the post-cutting constraining assembly 58 is best explained by referring additionally to FIGS. 5A and 5B. In the rest position, the moving blade 162 completely clears the outlet opening 48 and the alignment member 202 is aligned with the proximal side 154 of the outlet opening 48. The coined strip 30 travels through the outlet opening 48, over the alignment member 202, and into the post-cutting constraining assembly 58.

At the desired interval, the support bar 165 (and thus the moving blade 162 and the alignment member 202) are moved the appropriate direction (which is downward in the illustrated orientation) within the cutter guide tracks 166 to the cutting position. In this cutting position, the moving blade 162 interacts with the stationary blade 160 and the alignment member 202 is located remote from the outlet opening 48. In this manner, a leading portion of the coined strip 30 is cut into a cut section 32. The action of the moving blade 162 also sometimes tends to misalign the cut section 32 relative to the outlet opening 48 and/or the post-cutting constraining assembly 58.

The support bar 165 (and thus the moving blade 162 and the alignment member 202) are then moved in the opposite direction towards the rest position. Sometimes, the mere movement of the blade 162 in this direction will result in the cut section 32 "rebounding" back into alignment with the outlet opening 48 and/or the post-cutting constraining assembly 58. (See FIG. 5A.) However, as shown, the cut section 32 often remains at least partially misaligned even after this movement of the blade 162.

Once the support bar 165 (and thus the moving blade 162 and the alignment member 202) reach the rest position, the moving blade 162 once again completely clears the outlet opening 48. Also, quite significantly, the alignment member 202 is once again aligned with the proximal side 154 of the outlet opening 48. Thus, the movement of the alignment member 202 during the return stroke automatically "re-aligns" the cut section 32 with the outlet opening 48 and the post-cutting constraining assembly 58. In other words, the alignment device 200 insures a smooth transition for the cut section 32 from the outlet opening 48 into the post-cutting constraining assembly 58. In this manner, the cut section 32 steadily continues its downstream travel as it is pushed by the approaching coined strip 30. (See FIG. 5B.)

Figure 6:
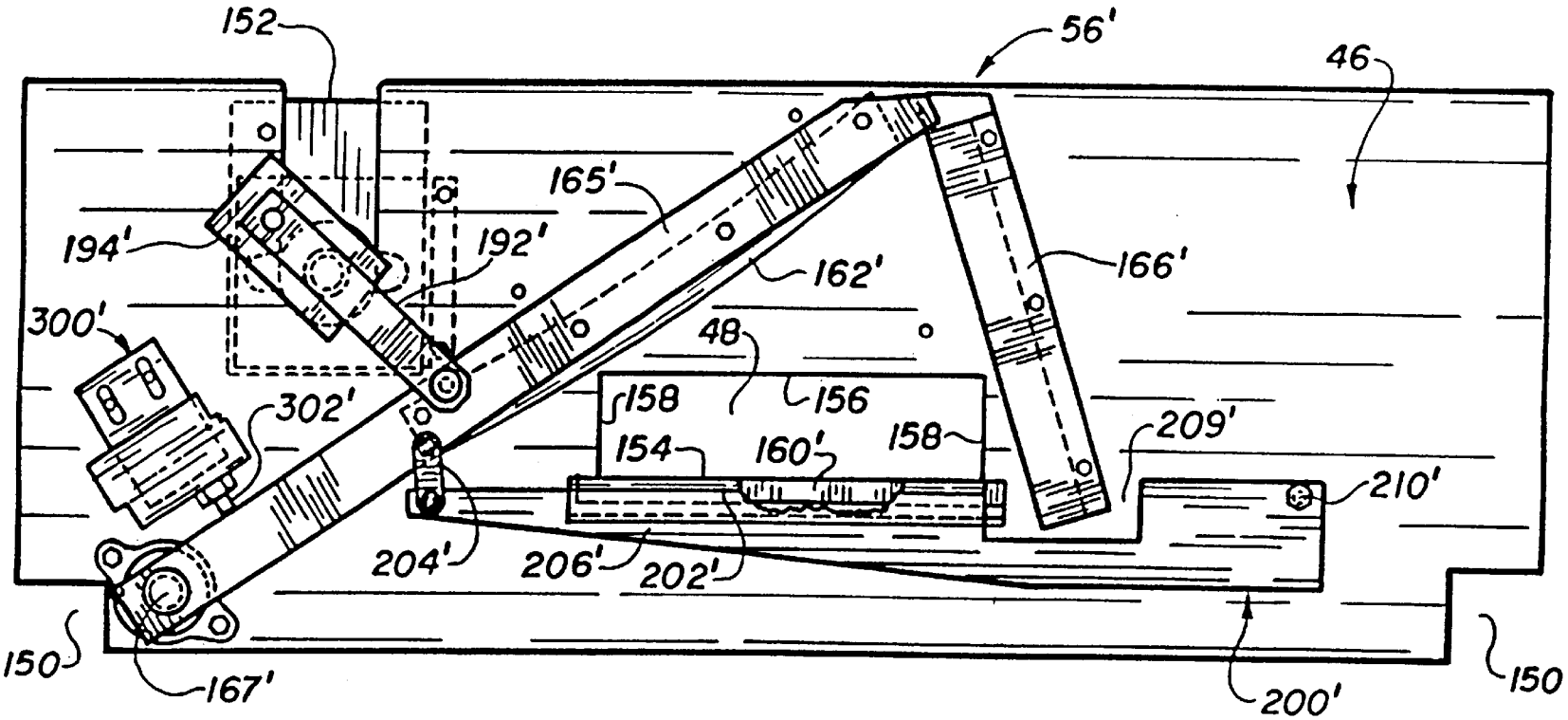
FIG. 6 is an isolated top view of another embodiment of the cutting assembly and relevant portions of the machine frame.

Another embodiment 56' of the cutting assembly is shown in FIG. 6. The cutting assembly 56' includes a stationary blade 160' and a moving blade 162', both of which are strategically positioned relative to the outlet opening 48. The blades 160' and 162' are the actual "cutting" elements of the cutting assembly 56' and coact in a scissor-like fashion to cut the coined strip 30 into cut sections 32. The stationary blade 160' is fixedly mounted on the frame end plate 46 in such a manner that it is aligned with the proximal side 154 of the outlet opening 48. The moving blade 162' is mounted on a support bar 165'. One end of the support bar 165' is slidably mounted on the end plate 46 within a cutter guide track 166'. The cutter guide track 166' is positioned beyond one lateral side 158 of the outlet opening 48 and slants toward its distal side 156. The bar 166' also extends beyond the proximal/distal sides 154/156 of the outlet opening 48.

The other end of the support bar 165' is pivotally attached to the end plate 46 at a pivot point 167'. An intermediate (but not exactly central) part of the support bar 165' is connected to a drive link 192' which is connected to a motion block 194'. A shaft (not specifically numbered) is connected at one end to the motion block 194' and extends from the downstream side of the frame end plate 46, through the open offset slot 152 to the upstream side of the plate 46. The opposite end of the shaft is operably connected to the cutter motor 57.

The cutting assembly 56' additionally includes an alignment device 200'. The alignment device 200' includes an alignment member 202' which is interconnected with the moving blade 162' via a connecting member 204'. The alignment device 202' additionally includes a support panel 206' which is orientated parallel to the end plate 46 and which includes a notch 209' for accommodating the cutter guide track 166'. The end of the support panel 206' closest to the cutter guide track 166' is pivotally attached to the end plate 46 at a pivot point 210'. In the cutter assembly 56', the alignment member 202' is a planar shelf which is attached to, and extends perpendicularly downstream from, the support panel 206'. Additionally, the connecting member 204' is a link member which is attached to an end (specifically, the end opposite the pivot point 210') of the support panel 206'.

During operation of the cutting assembly 56', the motion block 194' is rotated so that the moving blade 162' travels between a rest position and a cutting position. More specifically, the position of the drive link 192' is varied to move the support bar 165' (and thus the moving blade 162' and the alignment member 202') to and fro within the guide track 166' at a desired interval. As is explained in more detail below, as the motion block 194' is rotated 180° in one direction, the moving blade 162' makes a cutting stroke through the coined strip 30, and, as the motion block 194' is rotated 180° in the opposite direction, the moving blade 162' makes a return stroke to the rest position.

The interaction between the cutting blades 160'/162', the alignment device 200', and the post-cutting constraining assembly 58 is best explained by referring additionally to FIGS. 7A–7D. In the rest position, the moving blade 162' completely clears the outlet opening 48 and the alignment member 202' is aligned with the proximal side 154 of the outlet opening 48. (See FIG. 7A1.) The coined strip 30 travels through the outlet opening 48, over the alignment member 202', and into the post-cutting constraining assembly 58. (See FIG. 7A2.)

At the desired interval, the support bar 165' (and thus the moving blade 162' and the alignment member 202') are moved the appropriate direction (which is downward in the illustrated orientation) within the guide track 166' to the cutting position. (See FIG. 7B1.) In this cutting position, the moving blade 162' coacts with the stationary blade 160' and the alignment member 202' is located remote from the outlet opening 48. (See FIG. 7B2.) In this manner, the leading end of the coined strip 30 is cut into a cut section 32. As shown, the action of the moving blade 162' also sometimes tends to misalign the cut section 32 relative to the outlet opening 48 and/or the post-cutting constraining assembly 58.

The support bar 165' (and thus the moving blade 162' and the alignment member 202') are then moved in the opposite direction towards the rest position. (See FIG. 7C1.) Sometimes, the mere movement of the blade 162' in this direction will result in the cut section 32 "rebounding" back into alignment with the outlet opening 48 and/or the post-cutting constraining assembly 58. (See FIG. 7C2.) However, as shown, the cut section 32 often remains at least partially misaligned even after this movement of the blade 162'.

Once the support bar 165' (and thus the moving blade 162' and the alignment member 202') reach the rest position, the moving blade 162' once again completely clears the outlet opening 48. Also, quite significantly, the alignment member 202' is once again aligned with the proximal side 154 of the outlet opening 48. (See FIG. 7D1.) Thus, the movement of the alignment member 202' during the return stroke automatically "re-aligns" the cut section 32 with the outlet opening 48 and the post-cutting constraining assembly 58. (See FIG. 7D2.) In other words, the alignment device 200' insures a smooth transition for the cut section 32 from the outlet opening 48 into the post-constraining assembly 58. In this manner, the cut section 32 steadily continues its downstream travel as it is pushed by the approaching coined strip 30.

The cutting assembly 56' may further include an automatic interruption switch 300' which automatically temporarily stops the production of the coined strip 30, and thus its travel through the outlet opening 48, during the cutting process. Specifically, the switch 300' is electrically connected to the gear motor 55 which powers the gear assembly 54. As was explained above, the gear assembly 54 is the mechanism which "pulls" the stock material 22 from the stock roll 21, through the stock supply assembly 50, and through the forming assembly 52. Thus, if the power to the gear assembly 54 is interrupted, the production of the coined strip 30 will cease.

The automatic interruption switch 300' includes a depressible button 302' electrically designed to allow operation of the gear motor 55 when it is in a depressed condition and to interrupt operation of the gear motor 55 when it is in a released condition. When the cutting assembly 56' is in the rest position, the button 302' is depressed by the support bar 165' and thus the gear motor 55 may operate and the coined strip 30 may be produced. However, when the cutting assembly 56' begins a cutting stroke, and the support bar 165' moves downward, the button 302' is released, thereby interrupting operation of the gear motor 55 and production of the coined strip 30. When the cutting assembly 56' returns to the rest position, the button 302' will once again be depressed by the support bar 165' and the production of the coined strip 30 may continue. In this manner, the production of the coined strip 30 will be temporarily stopped during each cutting process.

One may now appreciate that the present invention provides an automatic alignment device which automatically "re-aligns" the cut section with an outlet opening and a post-cutting constraining assembly during the return stroke of a moving blade. Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A cushioning conversion machine for converting sheet-like stock material into cut sections of a pad-like cushioning dunnage product, said machine comprising a frame; conversion assemblies which are mounted on said frame and which convert the sheet-like stock material into the cushioning dunnage product; and a cutting assembly which is also mounted on said frame and which cuts the cushioning dunnage product into cut sections;

said frame including an outlet opening through which the cushioning dunnage product emerges;

said cutting assembly being mounted downstream of said outlet opening;

said cutting assembly comprising a first blade and a second blade, said second blade being mounted on said frame in such a manner that it travels in rectilinear motion between a rest position whereat it is removed from said first blade to a cutting position whereat it coacts with said first blade to cut the cushioning dunnage product into a cut section; and said cutting assembly further comprising an automatic alignment device which automatically aligns the cut section with the outlet opening when said second blade is moved from said cutting position to said rest position, said alignment device being coupled to said second blade for rectilinear motion together therewith;

said cutting assembly further comprising a support bar and a guide track at each end of said support bar, said second blade is fixedly mounted to said support bar, and said support bar is guided at its ends by said guide tracks.

2. A cushioning conversion machine as set forth in claim 1 wherein said first blade is stationarily mounted to said machine frame.

3. A cushioning conversion machine as set forth in claim 2 wherein said first blade is mounted to said machine frame adjacent said outlet opening.

4. A cushioning conversion machine as set forth in claim 1 wherein said first blade coacts with said second blade in a guillotine-like fashion.

5. A cushioning conversion machine as set forth in claim 1 further comprising a post-cutting constraining assembly which is mounted on said frame downstream of said cutting assembly and which circumferentially constrains the cut sections.

6. A cushioning conversion machine as set forth in claim 5 wherein said post-cutting constraining assembly includes an inlet which is aligned with said outlet opening whereby said automatic alignment device automatically aligns the cut section with said inlet when said second blade is moved from said cutting position to said rest position.

7. A cushioning conversion machine as set forth in claim 1 wherein:

said frame includes an end plate;

said outlet opening is located on said end plate;

said outlet opening is defined by a series of sides; and said first blade is fixedly mounted on said end plate in such a manner that it is aligned with one of said sides.

8. A cushioning conversion machine as set forth in claim 1 wherein said alignment device includes an alignment member and at least one connecting member interconnecting said second blade with said alignment member.

9. A cushioning conversion machine as set forth in claim 8 wherein said alignment member comprises a planar shelf.

10. A cushioning conversion machine as set forth in claim 1 wherein:

said machine further comprises a cutter motor which is mounted to said frame and which powers said cutting assembly; and said cutting assembly further comprises a drive link operably connecting said support bar, and thus said second blade and said alignment member, to said motor.

11. A cushioning conversion machine as set forth in claim 10 wherein said guide tracks are positioned beyond and parallel to lateral sides of said outlet opening.

12. A cushioning conversion machine as set forth in claim 10 wherein said cutting assembly further comprises a cutter linkage connecting said support bar to said drive link.

13. A cushioning conversion machine as set forth in claim 1 wherein:

said frame includes a frame base plate having an upstream end and a downstream end, a first upstream frame end plate extending generally perpendicularly from said upstream end of said frame base plate, and a second downstream frame end plate extending in substantially the same direction as said first frame end plate from said downstream end of said frame base plate;

said conversion assemblies include a forming assembly, a stock supply assembly, and a pulling/connecting assembly;

said forming assembly is mounted on said base frame plate intermediate said upstream end and said downstream end and causes inward rolling of the lateral edges of the sheet-like material into a generally spiral-like form whereby a continuous strip having two lateral pillow-like portions separated by a thin central band is formed;

said stock supply assembly is located upstream of said forming assembly, is mounted on said first frame end plate, and supplies the stock material to said forming assembly; and said pulling/connecting assembly is located downstream of said forming assembly, is mounted on an upstream side of said second frame end plate, and pulls the stock material from said stock supply assembly and through said forming assembly to form the continuous strip and connects the continuous strip along the central band whereby a coined strip of pad-like cushioning dunnage product is formed.

14. A cushioning conversion machine as set forth in claim 13 further comprising a post-cutting constraining assembly which is mounted on said frame downstream of said cutting assembly and which circumferentially and longitudinally constrains the cut sections.

15. A cushioning conversion machine as set forth in claim 14 wherein said post-cutting constraining assembly includes an inlet which is aligned with said outlet opening whereby said automatic alignment device automatically aligns the cut section with said inlet when said second blade is moved from said cutting position to said rest position.

16. A cushioning conversion machine for converting sheet-like stock material into cut sections of a pad-like cushioning dunnage product, said machine comprising a frame; conversion assemblies which are mounted on said frame and which convert the sheet-like stock material into the cushioning dunnage product;

said frame including an outlet opening through which the cushioning dunnage product emerges;

said cutting assembly being mounted downstream of said outlet opening;

said cutting assembly comprising a first blade fixed to the frame and a second blade movable with respect to the frame, said second blade having first and second end portions, said cutting assembly including guides fixed to said frame and slidably engaging the end portions of said second blade for straightline movement thereof between a cutting position engaging said first blade and a rest position separated from said first blade;

said cutting assembly further comprising an alignment device which aligns the cut section with the outlet opening when said second blade is moved from said cutting position to said rest position; and links connecting the end portions of the second blade to the alignment device for movement together therewith.

* * * * *